United States Patent [19]

Damron

[11] 4,374,312

[45] Feb. 15, 1983

[54] PANEL TYPE HEATING APPARATUS

[76] Inventor: John W. Damron, P.O. Box 402603, Dallas, Tex. 75240

[21] Appl. No.: 243,865

[22] Filed: Mar. 16, 1981

[51] Int. Cl.[3] ..... F24H 9/02

[52] U.S. Cl. ..... 219/345; 219/213; 219/517; 219/543; 219/548

[58] Field of Search ..... 219/313, 345, 355, 528, 219/543, 548, 549, 531, 535, 552, 553, 517

[56] References Cited

U.S. PATENT DOCUMENTS

| | | | |
|---|---|---|---|
| 2,503,457 | 4/1950 | Speir et al. | 219/345 |
| 2,977,450 | 3/1961 | Boicey | 219/543 X |
| 3,156,813 | 11/1964 | Trainor | 219/526 |
| 3,178,560 | 4/1965 | Mapp et al. | 219/528 |
| 3,179,544 | 4/1965 | Smith-Johannsen | 219/345 X |
| 3,385,959 | 5/1968 | Ames et al. | 219/549 |
| 3,397,302 | 8/1968 | Hosford | 219/528 |
| 3,423,574 | 1/1969 | Shomphe et al. | 219/528 |
| 3,591,753 | 7/1971 | Gartner | 219/543 X |
| 3,657,516 | 4/1972 | Fujihara | 219/345 |
| 3,781,526 | 12/1973 | Damron | 219/538 |
| 3,961,157 | 6/1976 | Miller et al. | 219/345 |
| 4,031,356 | 6/1977 | Niibe | 219/345 X |
| 4,158,078 | 6/1979 | Egger et al. | 219/345 X |

*Primary Examiner*—Volodymyr Y. Mayewsky
*Attorney, Agent, or Firm*—Hubbard, Thurman, Turner & Tucker

[57] ABSTRACT

A radiant panel type heating apparatus includes a heating element comprising a sheet of electrically conductive paper which generates heat as a result of resistance to current flow therethrough. The heating element includes spaced apart primary conductor elements comprising thin copper strips which are sewn to the conductive paper to provide uniform distribution of current flow through the paper from one conductor element to the other. The heating element is sandwiched between a main insulative panel member on one side and a heat conductive panel member one the other side to form a heat radiating surface. The heating element is secured in assembly with the panel members by strips of non-conductive and heat resistant double sided adhesive tape. The panel type heating apparatus may be provided in various geometric shapes and includes a thermal switch and fuse assembly to limit the maximum surface temperature of the heating element.

10 Claims, 5 Drawing Figures

PANEL TYPE HEATING APPARATUS

BACKGROUND OF THE INVENTION

1. Field of the Invention

The present invention pertains to a panel type heating apparatus comprising a relatively flat sheet of electrically conductive paper mounted between substantially rigid electrically insulated panel pieces which may be readily assembled and disassembled.

2. Background Art

It is known in the art of heating apparatus to utilize various types of electrically resistive elements which generate heat when current is applied thereto for providing localized heating for various applications. One particularly advantageous type of material suitable for uniform localized heating of small areas or elements comprises an electrically conductive paper characterized by binder material having electrically conductive material mixed therein to provide a sheet having conductor properties and exhibiting a finite electrical resistance. This so called electrically conductive paper is particularily advantageous for use in various types of heating elements such as those disclosed in my earlier U.S. Pat. No. 3,781,526. Although the type of electrically conductive paper used in the apparatus disclosed in my earlier patent as well as the apparatus disclosed and claimed herein is superior in many respects to other electrically conductive sheet materials, it has been found desirable in certain applications to improve the overall arrangement of the paper in combination with other elements of structure making up the complete heating apparatus in order to provide improved heating characteristics.

Another problem associated with earlier panel type heating units pertains to the method of attachment of the primary conductors or bus-bars to the conductive paper. It is desirable that the current flow and hence the heating of the paper be fairly uniform to provide maximum distribution of heat and to enhance the life of the material. Earlier methods of attaching the primary conductor elements to the conductive paper include the use of bonding agents or adhesives which are not entirely satisfactory as a means of attaching a metallic conductor element to the paper itself. Certain problems with resistance of the adhesive and the difficulty of controlling the thickness of the adhesive results in uneven distribution of current flow through the heating element.

The aforementioned problems in the development of suitable panel type heating apparatus utilizing electrically conductive paper or the like have been substantially overcome with the improved apparatus of the present invention.

SUMMARY OF THE INVENTION

The present invention comprises a panel type heating apparatus which is particularily adapted for localized heating of areas in offices, homes and other interior rooms which provides a relatively energy efficient source of heat for a small area.

The present invention also provides an improved panel type heating apparatus which may be used to heat objects such as food containers and virtually any object that may be placed in proximity to the heater and is required to be warmed to a temperature which will not tend to cause burns if contacted directly. Moreover, the heating apparatus of the present invention is relatively free of hazards associated with most types of electrical resistance heating elements.

The present invention further provides for a panel heater utilizing electrically conductive paper or the like, which heater is of improved construction and adapted for easy assembly or disassembly.

The present invention still further provides a panel type heating apparatus utilizing electrically conductive paper as a heating element which provides uniform heating over substantially the entire surface area of the paper and achieves heating primarily through radiation to the object or objects that are intended to be warmed. Although, direct conductive and convective heating is also accomplished to some extent by the apparatus of the present invention.

The improved panel heater of the present invention still further is characterized by the use of components manufactured of conventional materials combined in a new arrangement to improve the performance of the apparatus. The improved panel type heater is also economical to fabricate and assemble into heating units of various sizes and shapes and which may be disassembled in the event that the electrically conductive heating element of any component of the apparatus needs to be repaired or replaced.

The electrically conductive paper heating element used in conjunction with the apparatus of the present invention includes improved primary conductor members which are attached to the electrically conductive paper element by an economical and reliable technique which provides for adequate current flow area from the primary conductor element to the electrically conductive paper. The current flow area is uniformly distributed and presents minimal resistance to current flow into the paper itself.

One improved arrangement of a primary conductor element and the associated conductive paper is characterized by sewing the element to the paper with a conventional sewing machine stitch to provide a secure attachment of the conductor element while minimizing the resistance to current flow between the primary element and the paper. Such an arrangement also reduces the problem of uniform distribution of current flow from the primary conductor element to the conductive paper.

Other features, advantages and objects of the present invention will also be appreciated by those skilled in the art from the following detailed description when taken in conjunction with the drawings.

DETAILED DESCRIPTION OF PREFERRED EMBODIMENTS

Figure 1:
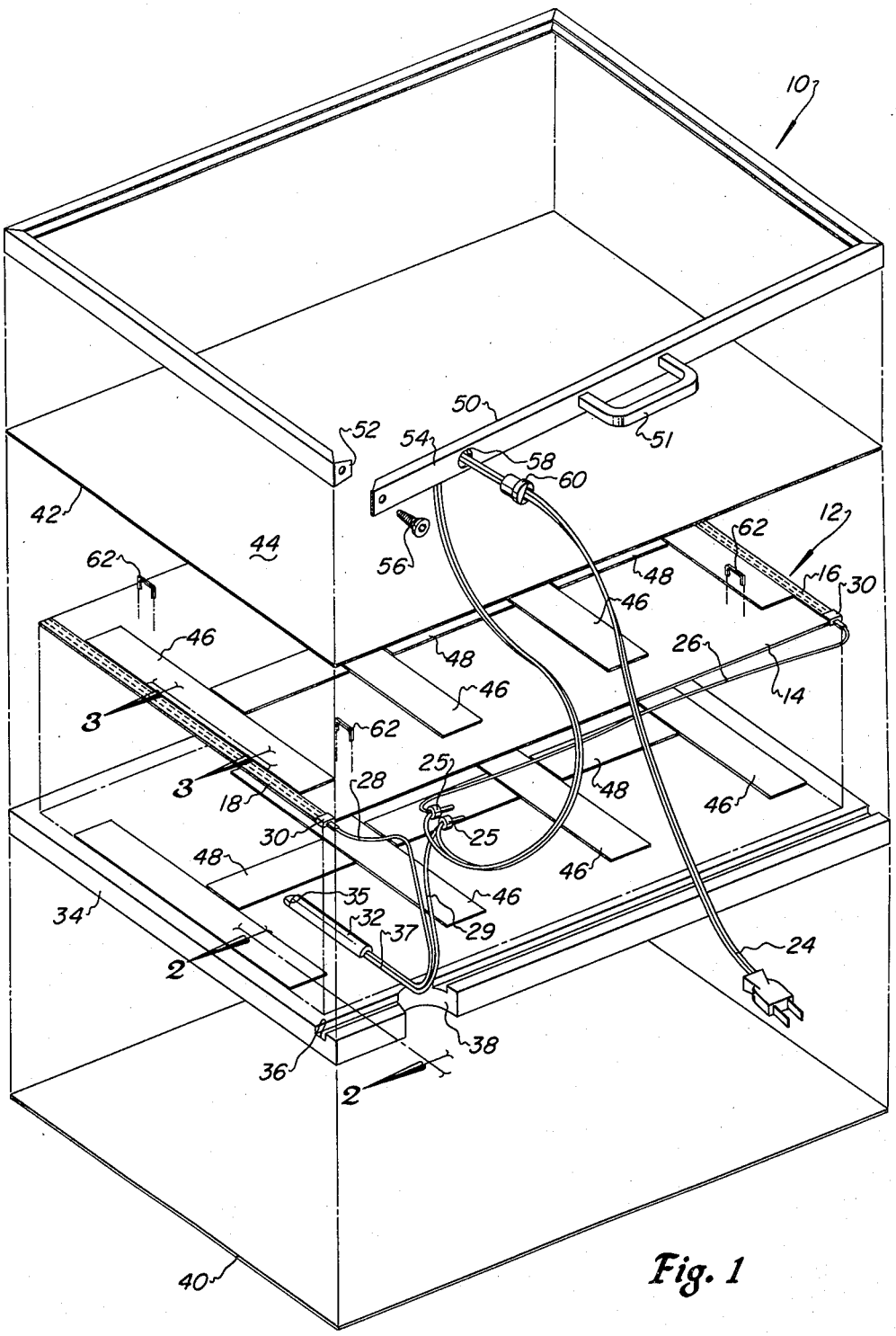
FIG. 1 is an exploded perspective view of the improved panel type heating apparatus of the present invention.

Referring to FIG. 1 of the drawings a panel type heating apparatus in accordance with the present invention is shown in an exploded perspective view and is generally designated by the numeral 10. The heating apparatus 10 is characterized by a heating element 12 comprising a planar sheet of electrically conductive paper 14 preferably of a type as disclosed in my U.S. Pat. No. 3,781,526. The electrically conductive paper is preferably approximately 0.031 inches thick and is formed by mixing approximately 80% commercial grade carbon with approximately 20% paper fiber during the manufacture of the paper. The paper fibers serve as a binder for the conductive carbon. The thickness of the sheet and the percentage of conductive element in the paper function to control the electrical resistance thereof. Resistance should preferably be maintained in a range between 100 and 1500 ohms per square ft. In one preferred embodiment according to the present invention, the nominal electrical resistance is 110 ohms per square ft. at 75° F. and in a panel of rectangular shape measuring approximately 21 inches by 17 inches has a nominal power consumption of 113 watts at 120 volts AC. The heating element 12 has a particularly uniform distribution of resistance and therefore a uniform distribution of heat generation. Heating results when current is passed through the paper from opposed primary conductor elements disposed along opposite edges of the paper and generally designated by the numerals 16 and 18 in FIG. 1.

Figure 3:
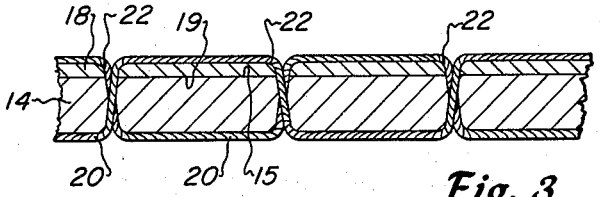
FIG. 3 is a detail section view taken substantially along the line 3—3 of FIG. 1.

The primary conductor elements 16 and 18 are characterized by elongated relatively thin strips of copper sheet approximately 0.002 inches in nominal thickness which, in accordance with a preferred embodiment of the present invention, are attached to the electrically conductive paper 14 by sewing thereto. Referring also to FIG. 3, a portion of the conductor element 18 is shown illustrating the attachment of the conductor element to the paper 14 with thread 20. The conductor element 18 may be applied to the paper 14 with a standard sewing machine stitch using the thread 20 which secures the conductor element to the paper and forms intimate contact between the conductor element and the paper particularly at the points 22 where the machine needle perforates the element 18 and forces the element into direct contact with the paper around the perforations. The surface 19 of the conductor element 18 is also contiguous with the surface 15 of the paper 14 between the perforations 22 due to the binding effect of the stitched thread 20. The primary conductor element 16 is attached to the paper of the heating element 12 in the same manner as described and shown for the conductor element 18.

Figure 4:
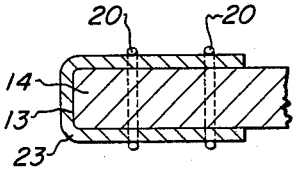
FIG. 4 is a detail section view illustrating an alternate embodiment of a primary conductor element attached to the conductive paper.

Although other methods of attachment of the conductor elements 16 and 18 can provide for relatively uniform distribution of current flow through the paper 14, the sewing of the thin metal primary conductor elements to the paper has proven to be a highly satisfactory attachment technique and provides an economical method of assembly or fastening of the conductor elements to the paper. In accordance with the present invention, the primary conductor elements may be attached along one surface of the paper member 14 or, as shown in FIG. 4, an alternate embodiment of a conductor element, generally designated by numeral 23, may be folded over the transverse edge 13 of the paper and sewn thereto with one or more rows of stitched thread 20.

Referring again to FIG. 1, the heating element 12 is suitably connected to a source of electrical power, not shown, by way of a double conductor electrical cord and plug assembly 24 which is suitably connected to separate insulated wire conductor leads 26 and 29. The conductor lead 26 is connected to the conductor element 16 and the conductor lead 29 is connected to the conductor element 18 by way of a switch and fuse assembly 32 and a lead 28. The conductors 26 and 28 are each provided with suitable crimp-type terminals 30 which are in direct contact with the elongated conductor elements 16 and 18. The terminals 30 may be of a type, for example, manufactured by Amp, Inc., Harrisburg, Pa., as their part number 329860 under the trademark Termafoil.

The electrical circuit aforedescribed includes a combination switch and fuse assembly, generally designated by the numeral 32 in FIG. 1, and which is interposed in the conductor leads 28 and 29. The switch and fuse assembly 32 is adapted to be contiguous with or in close proximity to the heating element 12 when the heating apparatus 10 is in an assembled condition. The switch and fuse assembly 32 may be of a suitable type to provide for opening the electrical circuit to the heating element 12 at a limit temperature which is below the temperature which would damage the heating apparatus 10 or result in ignition of any part thereof. The thermal switch and fuse assembly 32 may comprise a switch which opens on increasing temperature to provide a limit temperature for the heating element 12. For example, a suitable switch is one manufactured by Portage Electric as their model L and is set to open at a limit temperature of 65° C. The switch included in the assembly 32 is series connected to a thermal fuse of a type such as made by Microtemp, Inc. and characterized as a one-shot fuse which may be, for example, set for opening the electrical circuit to the heating element 12 at a temperature of 150° C. The switch and fuse aforedescribed are suitably enclosed in a fiberglass sleeve such as a type 155, manufactured by Essex Insulation Products Company. The combination of the switch and thermal fuse described above is believed to be readily understandable to those skilled in the art of electrical heating apparatus and further detailed description is not necessary as the switch and fuse assembly form no part of the present invention.

The panel type heating apparatus 10 is further characterized by a main structural and insulating panel member 34 comprising a rectangular plate which is dimensioned to be larger than the perimeter dimensions of the heating element 12. The panel member 34 is preferably made of a suitable non-conductive and heat insulating material which is also substantially rigid to serve as one of the primary structural members of the heating apparatus 10. One particularly suitable type of material for use in fabricating the panel member 34 is compressed particle board manufactured under the trademark Ceramaguard. The panel member 34 is provided with an elongated groove 36 formed adjacent one longitudinal side thereof. The groove 36 intersects a recess 38 and both the groove and recess are adapted to receive the conductor leads 26, 28 and 29 as well as connectors 25 for connecting the leads to the respective conductors of the cordset 24. For a panel type heating apparatus in accordance with the present invention, having nominal overall dimensions of approximately 22 inches by 18 inches, a suitable thickness of the panel member 34 would be approximately 0.50 inches to 0.63 inches.

Figure 2:
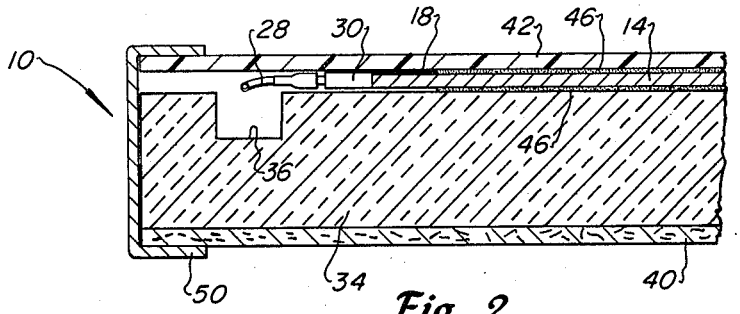
FIG. 2 is a detail section view taken along the line 2—2 of FIG. 1.

Referring further to FIG. 1 and to FIG. 2, the panel type heating apparatus 10 is also characterized by a back cover plate 40 having nominal dimensions the same as the panel member 34. The cover plate 40 may be of any suitable insulative material such as wood particle board or the like. The purpose of the cover plate 40 is primarily to serve as protection for the panel member 34 and, depending on the type of material used for the panel member 34, the cover plate 40 could be eliminated.

The panel type heating apparatus 10 is still further characterized by a front panel cover member, generally designated by the numeral 42, having the same peripheral dimensions as the panel member 34. The cover member 42 is preferably made of a laminated plastic which is chemically and heat resistant but is also adapted to be suitably heat conductive to provide a heat radiating surface for the apparatus. Although a number of different types of material may be used for the front cover member 42, a particularly preferred type of material is that manufactured under the trademark Formica as a grade FR decorative laminate. In fact, the front face 44 of the cover member 42 may be provided with a decorative finish to enhance the visual appeal of the apparatus 10. The cover member 42 may also be made of mirrored glass, whereby the apparatus 10 may be used in areas where the mirror may be kept free of condensation of moisture in the exterior surface thereof.

The heating element 12 is adapted to be mounted between the panel member 34 and the cover member 42 in sandwiched relationship and secured to the respective members to form a unitary structure by bonding material comprising elongated rectangular strips of tape 46 and 48. The strips of tape 46 and 48 are preferably arranged in a cross pattern as illustrated in FIG. 1. A suitable type of tape for use with the apparatus of the present invention is preferably an acrylic pressure sensitive transfer tape having an adhesive layer on both sides, and made by Dielectric Polymers, Inc. of Holyoke, Mass. under their product identification Neltape 140. The use of the spaced apart strips of tape 46 and 48 on opposite faces of the heating element 12 assures that, in assembly with the panel members 34 and 42, the paper member 14 remains in a flat and secure position between the panel members. Moreover, in the event that it is necessary to replace the heating element 12, the cover member 42 may be easily removed from the heating element and the heating element itself may be conveniently and easily removed from the main panel member 34.

The heating apparatus 10 also includes a perimeter frame, generally designated by the numeral 50 in FIG. 1, and comprising a rectangular rim having a channel or U-shaped cross-sectional configuration as illustrated in FIG. 2. The frame 50 may be formed from a suitable structural material also having a pleasing finish appearance and, for example, may be stainless steel of a relatively light gauge formed in the U-shaped or channel configuration illustrated. One corner of the frame 50 includes a tab 52 which is bent to lie contiguous with the adjacent leg 54 of the frame. The frame 50 may be fabricated to comprise a unitary structure except for the corner formed by the tab 52 and one end of the leg 54 to permit the frame to be spread and slipped over the assembly of the panel members 34, 40 and 42 and secured thereto in the manner illustrated in FIG. 2. The frame 50, upon assembly around the perimeter of the panel members 34, 40 and 42, may be suitably secured thereto by a fastener 56 comprising a screw or rivet. The frame 50 is also provided with an opening 58 to support a strain relief member 60 for the power supply cord set 24.

In a preferred method of assembly of the heating apparatus 10, the leads 26 and 28 are connected to the heating element 12 and the switch and fuse assembly 32 is disposed in a suitable recess 35 formed in the panel member 34. The depth of the recess 35 is sufficient to permit the outer surface of the sleeve of the switch and fuse assembly 32 to be contiguous with the surface of the heating element 12.

The leads 26 and 28 are then suitably disposed in the groove 36 as well as the groove 37 which intersects the recess 38.

In assembling the element 12 to the panel member 34 the tape strips 46 and 48 are disposed in a suitable pattern, as illustrated, on the face of the panel member and then the heating element 12 is positioned generally as indicated by the dashed lines in FIG. 1 and pressed into engagement with the tape strips. Additional securing means for the heating element 12 may be provided such as spaced apart staples 62 which should be oriented with respect to the conductor elements 16 and 18 as illustrated in FIG. 1. A similar pattern of tape strips 46 and 48 is then applied to the opposite surface of the heating element 12 so that the cover member 42 may be disposed over the heating element and pressed into engagement therewith in alignment with the periphery of the panel member 34.

The further assembly of the heating apparatus 10 would normally comprise connecting the leads 29 and 26 to the respective conductors of the power cord set 24 and disposing the connectors 25 within the recess 38. The power cord 24 would, normally, be threaded through the opening 58 in the frame 50 before attachment of the respective conductors to the leads 29 and 26.

The back panel 40 is then placed in alignment with the outer side of the panel member 34 followed by the securing of the frame 50 to the assembly of panel members aforedescribed and securing of the frame with the fastener 56.

As may be appreciated from the foregoing, the assembly of the heating apparatus 12 is easily accomplished and the apparatus may be disassembled if necessary for replacement of the heating element 12, the switch and fuse assembly 32, or any of the panel members 42, 34 and 40.

Figure 5:
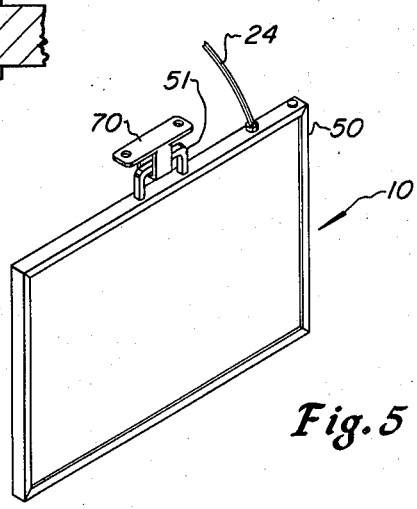
FIG. 5 is a perspective view of the heating apparatus illustrated in FIG. 1 and shown in an assembled condition.

Referring to FIGS. 1 and 5 the frame 50 may be provided with a variety of suitable handle means including a U-shaped handle portion 51 to provide for attaching the heating apparatus to any vertical surface, hanging the heating apparatus in various locations, and serving as a means of carrying the heating apparatus from one location to another. The handle 51 may, for example, be used to hang the heating apparatus from a suitable bracket 70 which may be attached to the underside of a desk or against a vertical wall or any surface to which the apparatus 10 is to be attached.

As will be appreciated from the foregoing, the panel type heating apparatus 10 provides a superior device for radiant heating of localized areas without requiring a substantial amount of energy. Thanks to the arrangement of the insulative panel member 34 disposed on one side of the heating element 12 and the heat conductive panel member 42 disposed on the opposite side of the heating element in a stacked or layered configuration, substantially all of the heat generated by the heating element is projected from the outer surface of the member 42 to warm persons and other objects without transferring the heat to the surrounding air by conventional convective heating. Accordingly, only the person or other object intended to be warmed receives the major portion of the heat generated by the apparatus.

Those skilled in the art will appreciate that various substitutions and modifications may be made to the specific arrangement of components, the materials described by way of example, and the overall configuration of the apparatus disclosed herein without departing from the scope and spirit of the invention recited in the appended claims.

What I claim is:

1. A panel type heating apparatus comprising:

a sheet of electrically conductive paper having a resistance to current flow and operable to generate heat when connected to a source of electric energy;

spaced apart primary conductor element means fixed to said sheet and to respective electrical conductor leads;

a first substantially rigid relatively thick walled member disposed on one side of said sheet, said member being of electrical and heat insulative material and forming a supporting surface for said sheet;

a second relatively thin walled member disposed on the opposite side of said sheet, said second member being of an electrically insulative but heat conductive material;

means for securing said sheet to at least one of said members, said securing means comprising at least one elongated strip of electrically non-conductive tape having an adhesive layer on opposite sides for securing said tape to said sheet and said one member whereby said sheet is secured against movement with respect to said one member; and means for securing said first and second members in assembled relationship with said sheet wherein said sheet is disposed between said members and is adapted to generate heat to be conducted by and radiated from said second member when electrical current is passed through said sheet.

2. The invention set forth in claim 1 wherein:

said sheet is secured to both of said members by plural strips of said tape.

3. The invention set forth in claim 1 wherein:

said means for securing said member and said sheet in assembled relationship includes a frame disposed around the periphery of said members in assembled relationship, said frame having a substantially U-shaped cross-section formed by a pair of spaced apart parallel flanges interconnected by a base portion.

4. The invention set forth in claim 1 wherein:

said second member comprises a sheet of thermosetting plastic laminate.

5. The invention set forth in claim 1 together with:

a thermal switch and fuse assembly disposed on said first member and contiguous with said sheet, said assembly being in circuit with said leads for interrupting the flow of electrical energy to said sheet at first and second predetermined temperatures.

6. The invention set forth in claim 1 wherein:

said primary conductor elements comprise elongated metal strips secured to opposed edges of said sheet.

7. The invention set forth in claim 6 wherein:

said metal strips are secured to said sheet by a sewn thread.

8. The invention set forth in claim 7 wherein:

said metal strips are folded over the edges of said sheet and are contiguous with said sheet on opposite sides thereof.

9. The invention set forth in claim 1 wherein:

said sheet has an electrical resistance in the range of 100 to 120 ohms per square foot of surface area.

10. The invention set forth in claim 1 wherein:

said second member comprises a sheet of glass.

* * * * *